US005934362A

United States Patent [19]

Barker, II

[11] Patent Number: 5,934,362

[45] Date of Patent: Aug. 10, 1999

[54] COMBINATION BATH FAN, REGISTER BOX, AIR CONDITIONING AND HEATING BOOT

[75] Inventor: Blaine F. Barker, II, Pearland, Tex.

[73] Assignee: Tele-Flow, Inc., Pearland, Tex.

[21] Appl. No.: 08/785,293

[22] Filed: Jan. 21, 1997

[51] Int. Cl.[6] ..... F25B 29/00; F24F 13/00; F24F 3/16; F24F 7/10

[52] U.S. Cl. ..... 165/48.1; 165/54; 165/237; 454/244; 454/249; 454/354; 454/349; 392/364; 362/92; 362/149; 362/294

[58] Field of Search ..... 165/48.1; 454/243, 454/244, 234, 235, 236, 124, 349, 341, 249, 303, 354, 245, 248; 392/364; 362/92, 149, 294

[56] References Cited

U.S. PATENT DOCUMENTS

| | | | |
|---|---|---|---|
| D. 315,790 | 3/1991 | Koessler | D23/388 |
| 1,038,625 | 9/1912 | Mies | 165/54 |
| 1,666,519 | 4/1928 | West . | |
| 2,628,550 | 2/1953 | King . | |

(List continued on next page.)

FOREIGN PATENT DOCUMENTS

| | | | |
|---|---|---|---|
| 2431065 | 1/1976 | Germany | 454/341 |
| 0136353 | 11/1978 | Japan | 454/249 |
| 56-91135 | 7/1981 | Japan | 454/354 |
| 0117040 | 6/1985 | Japan | 454/249 |
| 61-31840 | 2/1986 | Japan | 454/349 |
| 0282741 | 12/1986 | Japan | 454/249 |
| 0106240 | 5/1987 | Japan | 454/249 |
| 3-63436 | 3/1991 | Japan | 454/354 |
| 4-254135 | 9/1992 | Japan | 454/244 |

OTHER PUBLICATIONS

Tele–Flow, Inc. Product Brochure, Registers and Diffusers (no date).

Nutone Specification Sheet for Economy Exhaust Fans, Jul., 1990.

Florida Polymers, Installation Instructions for Zebra Fans, Model No. FP–50, Vent 50CFM (no date).

FASCO Consumer Products, Inc. Instructional Brochure for Models A647 and B647 Ventilators, dated May, 1994.

NuTone, Product Brochure for Home Ventilation Products, dated 1996.

*Primary Examiner*—John K. Ford
*Attorney, Agent, or Firm*—Browning Bushman

[57] ABSTRACT

A combination bath fan, register box, air conditioning and heating boot requires one opening on the wall or the ceiling of the bathroom, thus reducing the installation and maintenance costs associated with the ventilation of the bathroom. The combination includes a trim kit or assembly which is adapted to be fitted into a rough-in kit or assembly. The rough-in kit or assembly, typically mounted onto a building stud during the early phases of the building construction, has an air outlet which is connected to the outside air and an inlet for receiving conditioned air to be distributed within a confined space. The trim assembly or kit is installed in the rough-in assembly. Louvers are provided around the perimeter of the face plate of the trim assembly to dispense conditioned air from the air inlet to the confined space with the appropriate air gradient. Air flow through the louvers is controlled using one or more slidable dampers mounted above the louvers. Further, one or more baffles are positioned centrally on the face plate to guide the removal of stale air from the confined space. A fan housing having a motorized fan assembly is centrally positioned above the face plate to draw stale air and other odoriferous fumes from the confined space through the baffles and to eject the noxious fumes to the outside atmosphere. The present invention thus provides an economical, aesthetically pleasing, yet high performance air exchange system which can be installed in fewer steps and which provides a less intrusive appearance on the ceiling or wall of the confined space.

13 Claims, 9 Drawing Sheets

U.S. PATENT DOCUMENTS

| | | | |
|---|---|---|---|
| 2,780,981 | 2/1957 | Miller | 454/349 |
| 2,800,849 | 7/1957 | Spear | 454/354 |
| 3,103,156 | 9/1963 | Quin . | |
| 3,225,677 | 12/1965 | Steele . | |
| 3,590,719 | 7/1971 | Lambert | 454/303 |
| 4,665,806 | 5/1987 | Martin, Sr. | 98/40.12 |
| 4,681,024 | 7/1987 | Ivey | 454/234 |
| 4,730,551 | 3/1988 | Peludat | 98/315 |
| 4,846,261 | 7/1989 | Kittila | 165/54 |
| 5,259,816 | 11/1993 | Ke et al. | 454/244 |
| 5,372,182 | 12/1994 | Gore . | |

53
149
152
117
113
180
FP
112B
182
K3
116
164
162
160
141
M
V
142'
130
144
S
B
10
150
142
140
129
K1
100
114
110
112A

COMBINATION BATH FAN, REGISTER BOX, AIR CONDITIONING AND HEATING BOOT

BACKGROUND OF THE INVENTION

1. Field of the Invention

The present invention relates to an air exchange apparatus, and more particularly, to a combination bath fan, register box, air conditioning and heating boot.

2. Description of the Related Art

The annals of civilizations reveal that most humans share one common trait: the need for wealth, power and glory. As every generation searches for the easiest and fastest ticket to instant power and wealth, members of the world are confronted with a virtually insoluble dilemma—how to squeeze more productivity out of an already busy day. The need for ever increasing productivity thus places many members of society under increasing stress. In the frenzy created by modern lifestyles, bathrooms provide safe harbors from life's more hectic moments. Thus, bathrooms need to be as pleasant to use as possible.

Attempts at providing a more pleasant atmosphere in the bathroom have run afoul of problems principally caused by two agents: (1) odoriferous vapor and fume discharged by the occupant of the bathroom, and (2) heat generated by one or more heat generators such as the body of the occupant, light fixtures, hair dryers, and other motorized appliances. The fume and heat energy resulting from the use of the spatially confined bathroom can be quite offensive when the air is stagnated, as caused by the stratification of air masses.

Typically, masses of hot air are trapped below the ceiling in an upper portion of the room, while cooler air masses occupy a lower portion of the room. Such stratification is undesirable in that odors and noxious fumes are trapped. The trapping of noxious fumes and odors in the confined space of the bathroom is particularly uncomfortable and disrupts the occupant's pursuit of greater goals in life. This is especially so when the room is a small one, not having any opening in the exterior wall, such as a window that can be opened to allow fresh air to enter the room.

In order to improve the comfort of the occupant as well as the efficiency of the air conditioning/heating system for the bathroom, the air gradient throughout the bathroom needs to be emphasized such that undesirable and stale fumes and odors are removed while fresh air is circulated throughout the bathroom. With this goal in mind, modern building codes require that bathrooms be provided with an exhaust system vented to the atmosphere.

To overcome the aforementioned nefarious problems and to conform to the building codes, various systems have been developed with sufficient ventilation and distribution of air to provide a comfortable environment where citizens can relish in the civility of their building codes. It has been long recognized that the strongest source of noxious odors or vapors is centered around the toilet seat where the same is occupied by a person. In order for an odor exhaust device to function, a bathroom must have a source of suction or vacuum. Most building codes require an exhaust system, including an exhaust fan located in the ceiling or wall of the room in which the toilet is housed. There must also be an arrangement that permits the noxious odors from the toilet area to be withdrawn into the exhaust system. Many of the previously proposed devices utilized vents and other apertures on the wall communicating with passageways adjacent to the rear of the toilet seat and connected to one or more exhaust lines to the source of suction or vacuum.

Further, it is known in the art to utilize exhaust fans to direct warm air from the ceiling towards the outside atmosphere to provide the needed ventilation. Typically, a fan is mounted within a housing to draw air through an intake located at the base of the housing and discharges the air through the top of the housing near the ceiling. However, as the conventional exhaust fan can only be used to draw air in or out of a room, it is necessary to separately install another air passageway connected to the air conditioner or heater for drawing fresh conditioned air into the bathroom.

As the process for creating and securing two openings on the wall or the ceiling of the confined space requires twice as much labor and supporting material as the process for creating one opening on the wall or the ceiling, the labor and material cost associated with the installation of separate inlet and outlet and associated flexible ducts can be rather significant. Thus, conventional air exchange systems result in much wasted money as well as inconvenience in installing and maintaining the air exchange system. Further, separate air inlet and bathroom fan vent lend themselves to neither an aesthetic appearance nor an easy to clean or maintain assembly. As such, conventional solutions to the bathroom air exchange problem are antithetical to the economic dictates as well as the aesthetic requirements of a modern civilization.

SUMMARY OF THE INVENTION

A combination bath fan, register box, air conditioning and heating boot is provided which requires one opening on the wall or the ceiling of the bathroom, thus reducing the installation and maintenance costs associated with the ventilation of the bathroom. The combination includes a trim kit or assembly which is adapted to be fitted into a rough-in kit or assembly. The rough-in kit or assembly, typically mounted onto a building stud during the early phases of the building construction, has an air outlet which is connected to the outside air and an inlet for receiving conditioned air to be distributed within a confined space.

The trim kit or assembly is then installed in the rough-in kit or assembly. Louvers are provided around the perimeter of the face plate of the trim kit or assembly to dispense conditioned air from the air inlet to the confined space with the appropriate air gradient. Air flow through the louvers is controlled using one or more slidable dampers mounted above the louvers. Further, one or more baffles are positioned centrally on the face plate to guide the removal of stale air from the confined space. A fan housing having a motorized fan assembly is centrally positioned above the face plate to draw stale air and other odoriferous fumes from the confined space through the baffles and to eject the noxious fumes to the outside atmosphere.

The combination bath fan, register box, air conditioning and heating boot of the present invention thus provides an economical, aesthetically pleasing, yet high performance air exchange system which can be installed in fewer steps with less materials and which provides a less intrusive appearance on the ceiling or wall of the confined space. Thus, more quality time can be spent in the confined space of the bathroom to refresh the occupant and to prepare him or her for grander opportunities.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1:
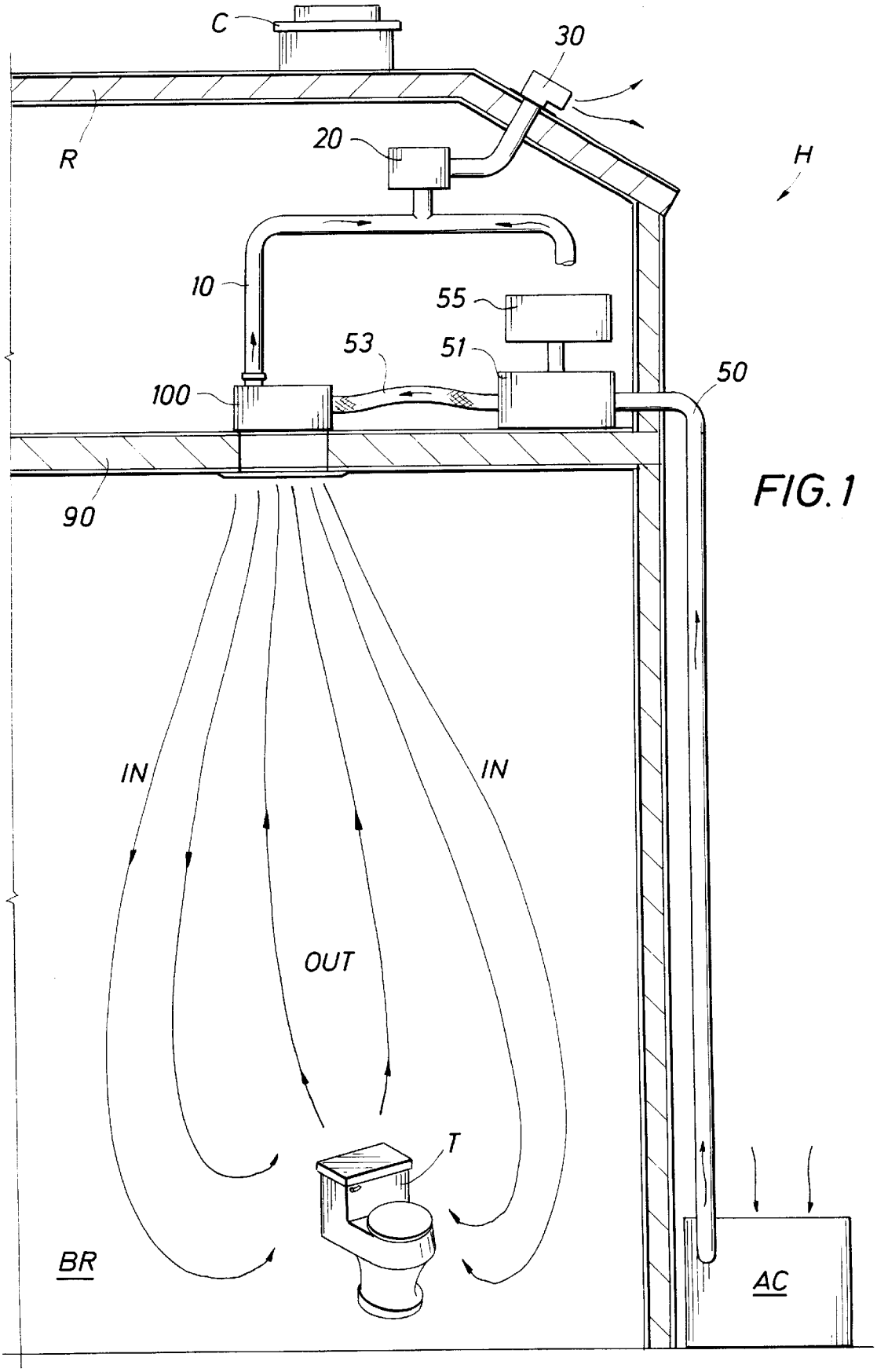
FIG. 1 is a perspective view of a house containing an air exchange system in accordance with the present invention.

Turning now to FIG. 1, a perspective, partially cross-sectional view of a house H having a bathroom BR is shown. The house H has a roof R and chimney C extending above the roof R which encloses flues that carry off smoke. Further, the house H has a ceiling 90 positioned between the roof R and the floor of the house to form an attic space. The ceiling 90 and one or more walls (not shown) section off and define a spatially enclosed area for the bathroom BR.

To ventilate and distribute air in the confined space of the bathroom BR, an air exchange unit 100 is mounted on the ceiling 90 directly above the bathroom BR. The air exchange unit 100 has an inlet which is adapted to receive and to distribute conditioned air into the enclosed bathroom BR. Further, the air exchange unit 100 has an outlet to ventilate the bathroom BR by ejecting stale, odoriferous air away from the bathroom BR into the outside atmosphere. To accomplish this goal, the air exchange unit 100 is connected to a ventilation duct 10. The ventilation duct 10 is eventually connected to a vented air collector unit 20. The vented air collector unit 20 is further connected to the outside atmosphere via an outside release unit 30 via one or more ducts.

The air exchange unit 100 has a motorized fan assembly (FIG. 2) for actively vacuuming and ejecting stale air from the bathroom BR through the ventilation duct 10, the vented air collector 20, and the outside release unit 30. Furthermore, the vented air collector unit 20 can also be assisted via a motorized fan or other means to actively remove the air from inside the house H to the outside atmosphere.

The air exchange unit 100 also receives conditioned air from a flexible duct 53. The flexible duct 53 can carry either heated air or cooled air, depending on the season. Further, the flexible duct 53 is connected to an air conditioning distribution unit 51 which is in turn connected to an air conditioner AC via an AC copper duct 50. The distribution unit 51 has cooling coils connected to the copper duct 50 and fans which move air about the cooling coils to produce conditioned air. Additionally, to compensate for cold temperature during the wintertime, a heater 55 can also be provided in the attic space above the ceiling 90, among others, to supply hot air to the air conditioning distribution unit 51 for subsequent distribution to habitable areas of the house H, including the bathroom BR.

Turning now to the bottom of FIG. 1, a toilet T is shown. When occupied, the toilet T is generally the source of the odoriferous air which needs to be removed. The odoriferous air is removed by the air exchange unit 100 of the present invention as follows: when the air exchange unit 100 is activated, either manually via a switch (not shown), or automatically via a proximity sensor (FIG. 7), conditioned air from the flexible duct 53 is evenly distributed over the entire housing of the air exchange unit 100 via one or more air distribution channels within the air exchange unit 100. The conditioned air is subsequently discharged through one or more louvers of the air exchange unit 100. This fresh air coming into the bathroom BR is marked as IN in FIG. 1. As the fresh air IN is cooled by the air conditioning unit AC, it gravitates toward the floor of the bathroom BR. Further, during use, the air inside the bathroom BR is heated by the human body or by equipment such as hair dryers. As the hot air is lighter, it generally rises toward the ceiling 90 of the bathroom BR. This rising air is indicated as OUT in FIG. 1. As the hot air rises toward the ceiling 90 containing the air exchange unit 100, the odoriferous fumes and stale air are actively removed by an impeller and a motor mounted within the air unit 100 and ejected via the ventilation duct 10 to the vented air collector unit 20 and eventually to the outside release 30 to be released back into the atmosphere.

As best seen in FIG. 1, air flow within the bathroom BR forms an inverted vortex where fresh air is injected at the perimeter of the air exchange unit 100 and stale or odoriferous air is removed approximately at the center of the air exchange unit 100 via series of motorized fan assembly and ducts. Thus, the flow of air thoroughly scavenges the interior of the bathroom BR removing the vitiated air and constantly supplying the occupant of the bathroom BR with fresh air to provide the occupant with a pleasant atmosphere such that he or she emerges from the confined space refreshed and ready to tackle other worldly problems.

Figure 2A:
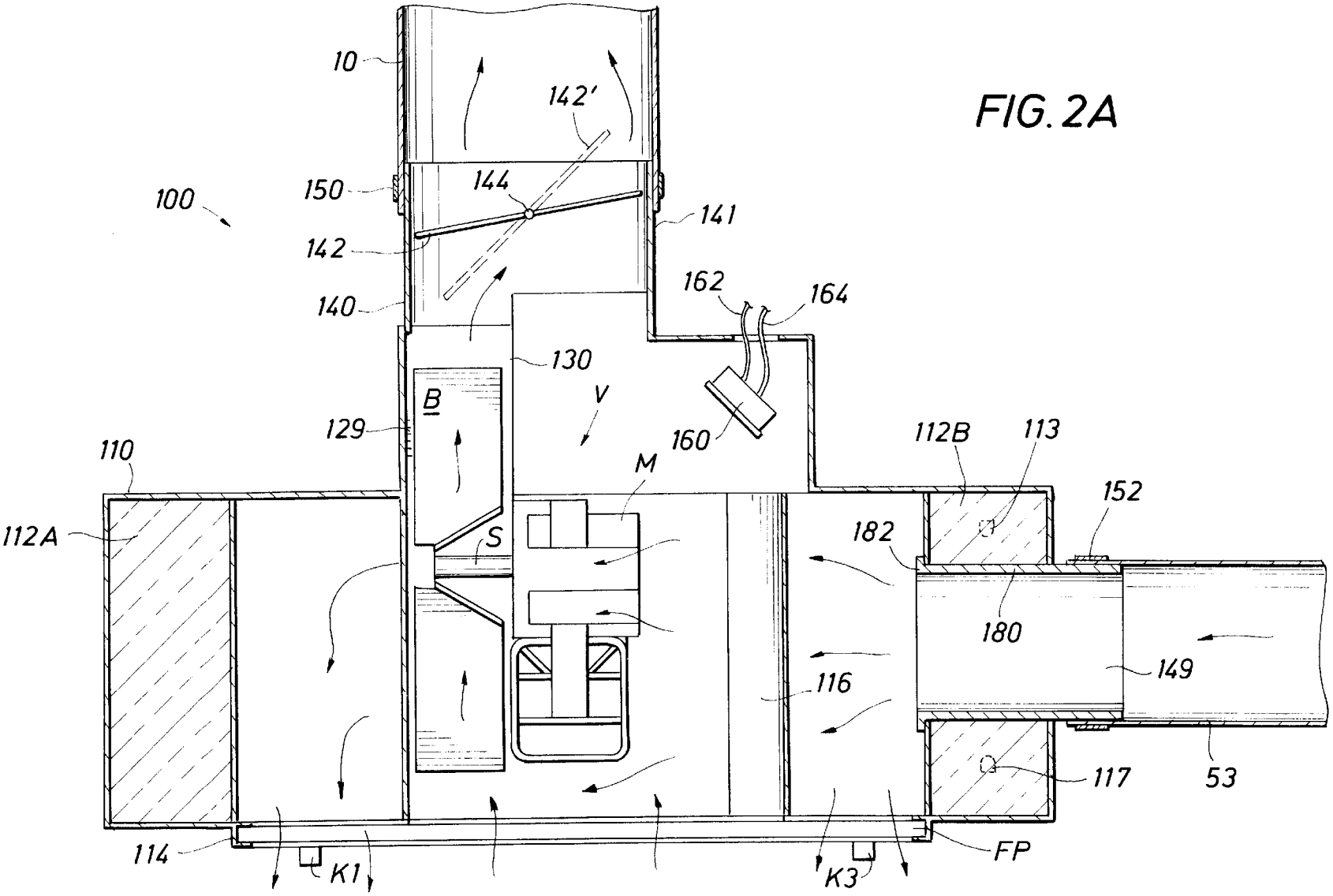
FIG. 2A is a side cross-sectional view of a first embodiment of the air exchange system of FIG. 1 according to the present invention.

Referring now to FIG. 2A, the air exchange unit 100 is shown in more detail. In FIG. 2A, a rough-in housing 110 forms a foundation for the air exchange unit 100. The rough-in housing 110 is generally rectangular or square in shape. Furthermore, the rough-in housing 110 has a top portion and four sidewalls extending downwardly from the top portion to form a box with an open bottom. The rough-in housing 110 may be formed of any suitable, rigid material, such as metal or plastic, and is formed to produce a rigid shape having sufficient strength to support the various elements.

Along a lower edge of each of the sidewalls of the rough-in housing 110 is a lip or flange 114 extending inwardly normal to the respective sidewalls. Each lip or flange 114 is formed to rest on the ceiling 90 to support the rough-in housing 110 in the suspended ceiling 90 as best shown in FIG. 1. The sidewalls extend a lesser distance from the top portion to provide a gap that occurs on the lower edge of the sidewall. As will be set forth more fully below, the lip or flange 114 is provided to accept a face plate FP having a fan kit or assembly mounted on top. During the final stages of construction, the face plate FP with the fan kit or assembly is inserted through the gap at the center of the rough-in housing 110 and connects to the upper side of the lip 114 about the ceiling 90.

Generally, the rough-in housing 110 is attached to a building stud during the early phases of the construction of the bathroom. Further, during the early phases of the home construction, the appropriate ducts are maneuvered by the construction crew such that one end of the ventilation duct 10 is placed physically adjacent to the vent exit collar or neck 141 of the rough-in housing 110. Similarly, one end of the flexible duct 53 which conveys conditioned air is also positioned proximately close to the air inlet neck 149 of the rough-in housing 110. Furthermore, the rough-in housing 110 has one or more mounting openings 113 and 117 to facilitate the installation of the sheet metal of the rough-in housing 110 to the air ducts, among others.

The housing 110 also has a layer of insulation barrier, preferably fiberglass insulation, placed around the perimeter of the rough-in housing 110. As best shown in the cross-sectional view of FIG. 2, insulation barriers 112A and 112B are shown extending from the outside of the rough-in housing toward the center of the rough-in housing 110. The insulation barrier thus contributes to an economical operation of the air conditioner AC or the heater 55 by minimizing convective or radiative conditioning energy losses emanating from the housing 110.

During the final phases of the construction of the bathroom BR, the bath fan kit or assembly having the face plate FP and the motorized fan assembly is inserted into the hollowed-out portion of the rough-in housing 110. The face plate FP, as shown in more detail in FIG. 4, has a plurality of louvers around the perimeter of the face plate FP. The louvers are adapted to receive incoming conditioned air and to distribute the incoming air IN into the confined space of the bathroom BR. Further, the face plate FP has a plurality of reticulated outlet air guides for removing stale air OUT from the bathroom BR. Also, a series of slidable dampers enable the consumer to control the volume and direction of air flow. The present invention also contemplates that an optional air filter can be positioned above the face plate FP to remove dust and other undesirable contaminants if necessary.

Referring to the preferred embodiment of FIG. 2A, mounted on top of the face plate FP is a fan housing 116. The fan housing 116 has an extended or telescoping neck portion 130. The neck 130 has a plurality of guide marks 129 positioned on the side of the neck 130 to assist in the proper placement of the bath fan kit or assembly heightwise. The neck 130 is designed to accept a receptacle 140 of a vent exit neck or collar 141. Furthermore, a coupling adapter or bracket 150 securely attaches the duct 10 to the neck 141.

Mounted within the collar 141 is a damper 142 which limits airflow in only one direction, namely in the direction from the confines of the bathroom BR to the outside atmosphere and not the other way around. As such, dust and other contaminants are prevented from going back into the bathroom BR. The damper 142 is rotatably coupled to the collar 141 via a pin 144 which may be placed extending through the center of the tube or collar 141 as shown, or may be placed at an offset from the center to provide the requisite opening and closing force.

The fan housing 116 contains a motor M having a shaft S. The shaft S is connected to an impeller or a paddle fan blade B. The motor M is bracketed to the fan housing 116 using appropriate means such as bolts or rivets. Further, the fan blade B is rotatably mounted to the shaft S of the motor M, preferably at a ninety degree angle to the motor M. Thus, the mounting of the fan blade B or the air impeller and the motor M reduces the overall axial length of the fan blade B in the motor and the height of the fixture as whole, resulting in a more compact fan assembly.

A suitable electrical access opening 163 (FIG. 2B) is provided, which includes a flexible cord and plug for an electrical connector 160 having wire leads 162 and 164. The electrical connector 160 (FIG. 2A) is eventually coupled to an alternating current (AC) socket to provide power to the motor M. Furthermore, the flow of energy to the wire leads 162 and 164 is controlled by either an electrical switch (not shown) or by a proximity detector and associated electronics which turn on the fan when one or more individuals are in the bathroom BR.

Initially, the damper 142 is at a rest position which seals off the fan housing chamber 116 from the outside atmosphere. During operation, the motor M is energized, thereby imparting a rotation to the impeller or the paddle fan blade B which draws the air into the upper compartment and through the neck 130 to be eventually expelled. Outgoing air is drawn from the air guides through the face plate FP around the motor M to be ejected via the impeller or fan blade B through the neck 130. Thus, when the motor M is energized and the fan blade B rotates, air is ejected through the neck 130 to the receptacle 140. In addition to the ejection of the air from the confines of the bathroom BR, the air convection further desirably cools down the motor M. Furthermore, upon the operation of the motor M, air pushes the round damper 142 into an open position 142' (FIG. 2) to allow air to escape the collar 141. Thus, odorific fumes or stale air escape through the damper in its open position 142' through the ventilation duct 10 and eventually to the outside atmosphere.

In sum, the fan blade F is mounted such that when it rotates, a draft of air is generated such that air is vectored from the bottom of the fan housing and propelled through the neck portion 130. Further, air movement is routed such that the motor M is also suitably cooled by the air currents moving through the motor M on its way to the neck portion 130.

Preferably, side 112B is made from a duct board material which permits the cutting of a round or oval opening at the center of the duct board material. Alternatively, the side 112B can also be made of a light gauge sheet metal. After the opening has been created on the duct board material, a duct board starting collar 180 is attached to the opening. The duct board starting collar 180 has a plurality of fingers 182 which secure the starting collar 180 to the duct board of side 112B. The duct board starting collar 180 has a neck portion 149 which is adapted to be inserted into the flexible duct 53. Furthermore, a coupling adapter or bracket 152 securely attaches the duct 53 to the neck portion 149.

Figure 2B:
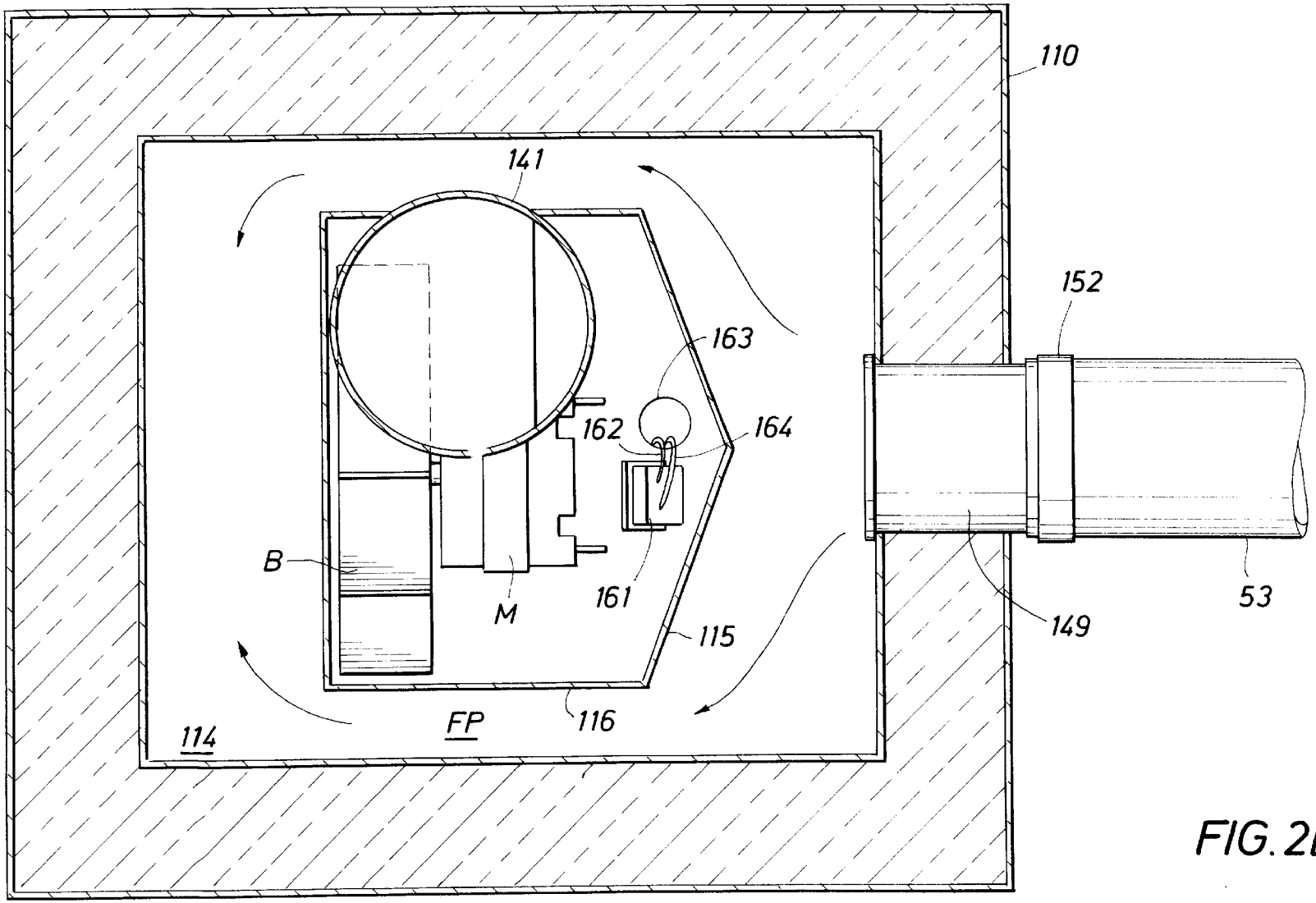
FIG. 2B is a top cross-sectional view of the air exchange system of FIG. 2A according to the present invention.

Referring now to FIG. 2B, a cross-sectional top view of the preferred air exchange apparatus of the present invention is shown. The preceding explanation of FIG. 2A will generally apply in describing the cross-sectional view of FIG.

2B. Hence, similarly numbered elements bear the same description and need not be discussed further.

In FIG. 2B, the electrical access opening 163 allows wire leads 162 and 164 to penetrate through the rough-in housing 110. Further, the wire leads 162 and 164 are electrically connected to a detachable fan electrical receptacle 161 for connecting into the outside power outlets for powering the motor M of the fan assembly.

Additionally, it is to be noted that the housing 116 has an angled surface 115 which generally directs air flow around the perimeter of the housing 116 before the air flows into the bathroom via the face plate FP. The present invention contemplates that other modification may be made to the angled surface 115 without alternation of the operating principle of this device and of the air exchange unit 100, including the termination of the air inlet in an oval shape or any other shape, and of different sizes may be required to fit the ducts as hereinbefore disclosed, depending upon the particular design of the conjoined air conditioning unit.

When air is supplied to the flexible duct 53, the incoming air encounters the angled surface 115 directs air into the sides of the housing 116. After such air flow redistribution, air is ejected through passages in the perforated panel of the face plate FP before it is guided through the louvers connected to the face plate and delivered into the bathroom chamber.

Figure 2C:
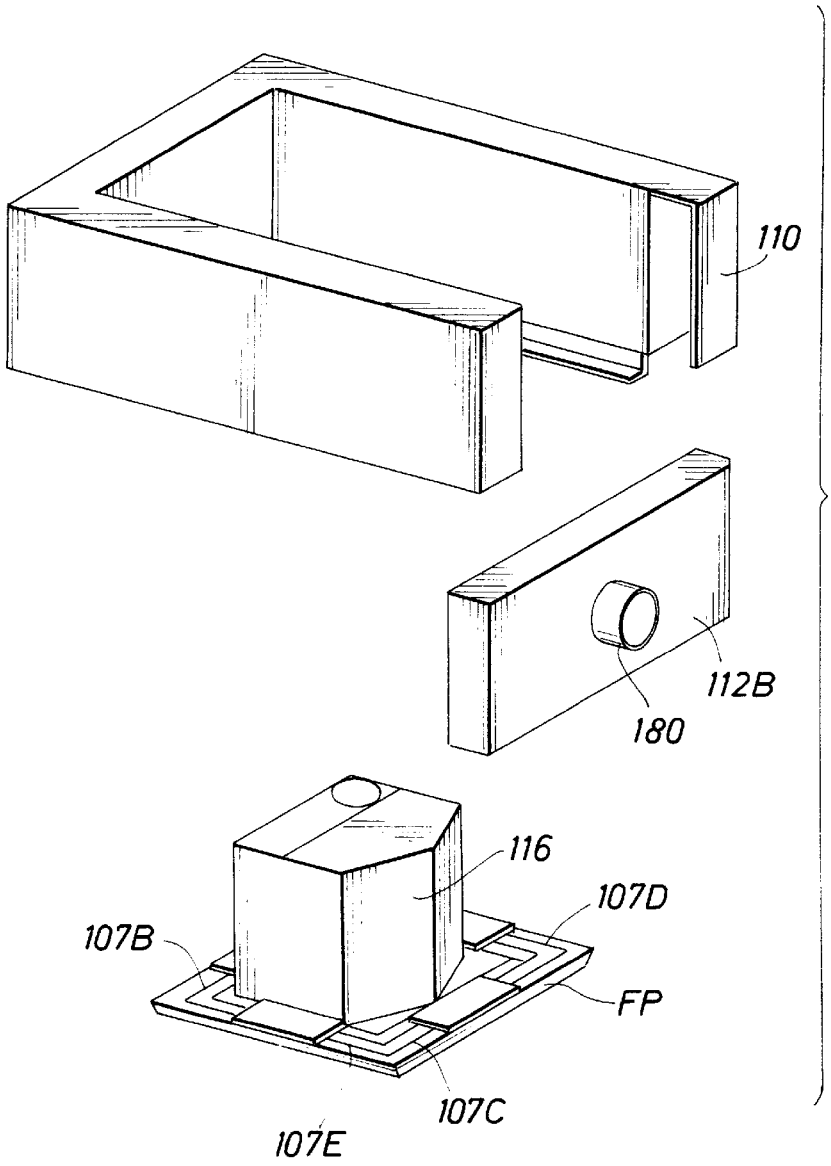
FIG. 2C is an exploded view of major components of the air exchange system of FIG. 2A.
Figure 2D:
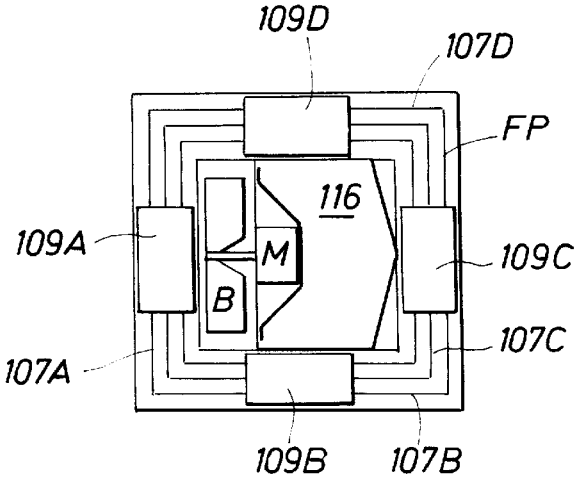
FIG. 2D is a top view of a face plate for the air exchange system of FIG. 2A.

FIG. 2C is an exploded illustration of the air exchange device of FIG. 2A. As shown in FIG. 2C, a metal sheet is formed into the rectangular housing 110 with an open side. The duct board 112B with an opening adapted to receive the starting collar 180 is then inserted into the open side to complete the housing 110. Next, the face plate with the fan assembly 116 is inserted into the bottom of the housing 110 to complete the assembly of the combination bath fan, register box, air conditioning and heating boot. As illustrated in FIG. 2C and further illustrated in the top view of the face plate FP in FIG. 2D, the face plate FP has a plurality of turning vanes 107A, 107B, 107C and 107D molded in the back of the face plate FP to further direct air flow around the perimeter of the fan assembly housing 116. Further, a plurality of slidable damper assemblies 109A, 109B, 109C and 109D are positioned on each of the four sides of the face plate FP. Each of the slidable damper assembly has a directional vane molded into the face plate FP at an angle. On the back side of the face plate FP, a sliding damper piece is snapped into the body of the face plate FP. The sliding damper piece of the damper assemblies 109A, 109B, 109C and 109D has a knob connected to respective sliding surface which, when adjusted, can restrict or enhance air flow through the vanes to provide air flow adjustability.

Figure 3A:
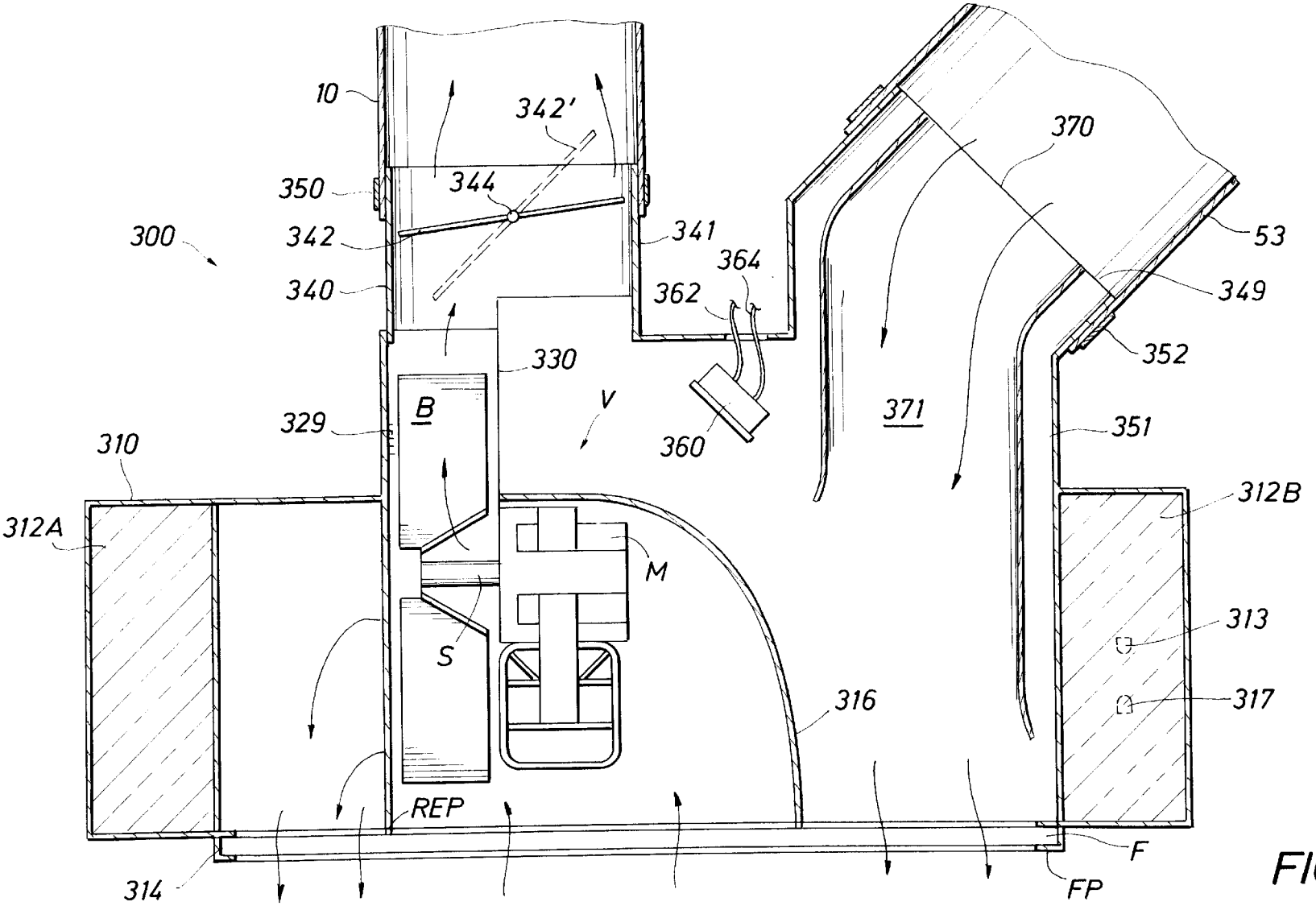
FIG. 3A is a side cross-sectional view of a second embodiment of the air exchange system of FIG. 1 according to the present invention.

The embodiment of FIG. 3A is adapted to receive incoming conditioned air at the top of the air exchange system. The embodiment of FIG. 3 A adds a transition plenum 351 which projects vertically upward to receive incoming air from the top. Referring now to FIG. 3A, the air exchange unit 300 is shown in more detail. In FIG. 3A, a rough-in housing 310 forms a foundation for the air exchange unit 300. The rough-in housing 310 is generally rectangular or square in shape. Furthermore, the rough-in housing 310 has a top portion and four sidewalls extending downwardly from the top portion to form a box with an open bottom. The rough-in housing 310 may be formed of any suitable, rigid material, such as metal or plastic, and is formed to produce a rigid shape having sufficient strength to support the various elements.

Along a lower edge of each of the sidewalls of the rough-in housing 310 is a lip or flange 314 extending inwardly normal to the respective sidewalls.

Each lip or flange 314 is formed to rest on the ceiling 90 to support the rough-in housing 310 in the suspended ceiling 90 as best shown in FIG. 1. The sidewalls extend a lesser distance from the top portion to provide a gap that occurs on the lower edge of the sidewall. As will be set forth more fully below, the lip or flange 314 is provided to accept a face plate FP having a fan kit or assembly mounted on top. During the final stages of construction, the face plate FP with the fan kit or assembly is inserted through the gap at the center of the rough-in housing 310 and connects to the upper side of the lip 314 about the ceiling 90.

Generally, the rough-in housing 310 is attached to a building stud during the early phases of the construction of the bathroom. Further, during the early phases of the home construction, the appropriate ducts are maneuvered by the construction crew such that one end of the ventilation duct 110 is placed physically adjacent to the vent exit collar or neck 341 of the rough-in housing 310. Similarly, one end of the flexible duct 53 which conveys conditioned air is also positioned proximately close to the air inlet neck 349 of the rough-in housing 310. Furthermore, the rough-in housing 310 has one or more mounting openings 313 and 317 to facilitate the installation of the sheet metal of the rough-in housing 310 to the air ducts, among others.

The housing 310 also has a layer of insulation barrier, preferably fiberglass insulation, placed around the perimeter of the rough-in housing 310. As best shown in the cross-sectional view of FIG. 3 A, insulation barriers 312A and 312B are shown extending from the outside of the rough-in housing toward the center of the rough-in housing 310. The insulation barrier thus contributes to an economical operation of the air conditioner AC or the heater 55 by minimizing convective or radiative conditioning energy losses emanating from the housing 310.

During the final phases of the construction of the bathroom BR, the bath fan kit or assembly having the face plate FP and the motorized fan assembly is inserted into the hollowed-out portion of the rough-in housing 310. The face plate FP further has a plurality of louvers around the perimeter of the face plate FP. The louvers are adapted to receive incoming conditioned air and to distribute the incoming air TN into the confined space of the bathroom BR. Further, the face plate FP has a plurality of reticulated outlet air guides for removing stale air OUT from the bathroom BR. Additionally, a repository REP optionally is positioned above the face plate FP. The optional repository REP is adapted to receive an optional air filter F which removes dust and other undesirable contaminants from entering the bathroom BR.

Referring to FIG. 3A, mounted on top of the repository REP or alternatively, in the event that the air filtering is not needed, on top of the face plate FP is a fan housing 316. The fan housing 316 has an extended or telescoping neck portion 330. The neck 330 has a plurality of guide marks 329 positioned on the side of the neck 330 to assist in the proper placement of the bath fan kit or assembly heightwise. The neck 330 is designed to accept a receptacle 340 of a vent exit neck or collar 341. Furthermore, a coupling adapter or bracket 350 securely attaches the duct 10 to the neck 341.

Mounted within the collar 341 is a round damper 342 which limits airflow in only one direction, namely in the direction from the confines of the bathroom BR to the outside atmosphere and not the other way around. As such, dust and other contaminants are prevented from going back into the bathroom BR. The round damper 342 is rotatably coupled to the collar 341 via a pin 344.

The fan housing 316 contains a motor M having a shaft S. The shaft S is connected to an impeller or a paddle fan blade B. The motor M is bracketed to the fan housing 316 using appropriate means such as bolts or rivets. Further, the fan blade B is rotatably mounted to the shaft S of the motor M, preferably at a ninety degree angle to the motor M. Thus, the mounting of the fan blade B or the air impeller and the motor M reduces the overall axial length of the fan blade B in the motor and the height of the fixture as whole, resulting in a more compact fan assembly.

A suitable electrical access opening 363 (FIG. 3B) is provided, which includes a flexible cord and plug for an electrical connector 360 having wire leads 362 and 364. The electrical connector 360 (FIG. 3A) is eventually coupled to an alternating current (AC) socket to provide power to the motor M. Furthermore, the flow of energy to the wire leads 362 and 364 is controlled by either an electrical switch (not shown) or by a proximity detector and associated electronics which turn on the fan when one or more individuals are in the bathroom BR.

Initially, the round damper 342 is at a rest position which seals off the fan housing chamber 316 from the outside atmosphere. During operation, the motor M is energized, thereby imparting a rotation to the impeller or the paddle fan blade B which draws the air into the upper compartment and through the neck 330 to be eventually expelled. Outgoing air is drawn from the air guides through the face plate FP around the motor M to be ejected via the impeller or fan blade B through the neck 130. Thus, when the motor M is energized and the fan blade B rotates, air is ejected through the neck 330 to the receptacle 340. In addition to the ejection of the air from the confines of the bathroom BR, the air convection farther desirably cools down the motor M. Furthermore, upon the operation of the motor M, air pushes the round damper 342 into an open position 342' (FIG. 3A) to allow air to escape the collar 341. Thus, odorific fumes or stale air escape through the round damper in its open position 342' through the ventilation duct and eventually to the outside atmosphere.

In sum, the fan blade F is mounted such that when it rotates, a draft of air is generated such that air is vectored from the bottom of the fan housing and propelled through the neck portion 330. Further, air movement is routed such that the motor M is also suitably cooled by the air currents moving through the motor M on its way to the neck portion 330.

Turning now to the incoming air management system operating in conjunction with the fan housing 316, a transition plenum 351 in FIG. 3A is positioned adjacent to the fan housing 316. The transition plenum 351 has a neck 349 which is adapted to be inserted into the flexible duct 53. Furthermore, a coupling adapter or bracket 352 securely attaches the duct 53 to the neck 349.

Disposed within the transition plenum 351 is an air channeling guide 371. The air channeling guide 371 acts to compartmentalize the rough-in housing 310 into subsections such that air is evenly distributed from the flexible duct 53 throughout the rest of the rough-in housing 310 for subsequent distribution into the confines of the bathroom BR.

Further, sitting atop the air channeling guide 371 is a ridge 370. The ridge 370 receives the incoming air from the flexible duct 53 and guides the air into the different chambers of the rough-in housing as discussed previously. Furthermore, depending upon the particular design of the air distribution system, modifications of the shape and the size of the ridge 370 may be made as may be required of the transition plenum neck 349.

Figure 3B:
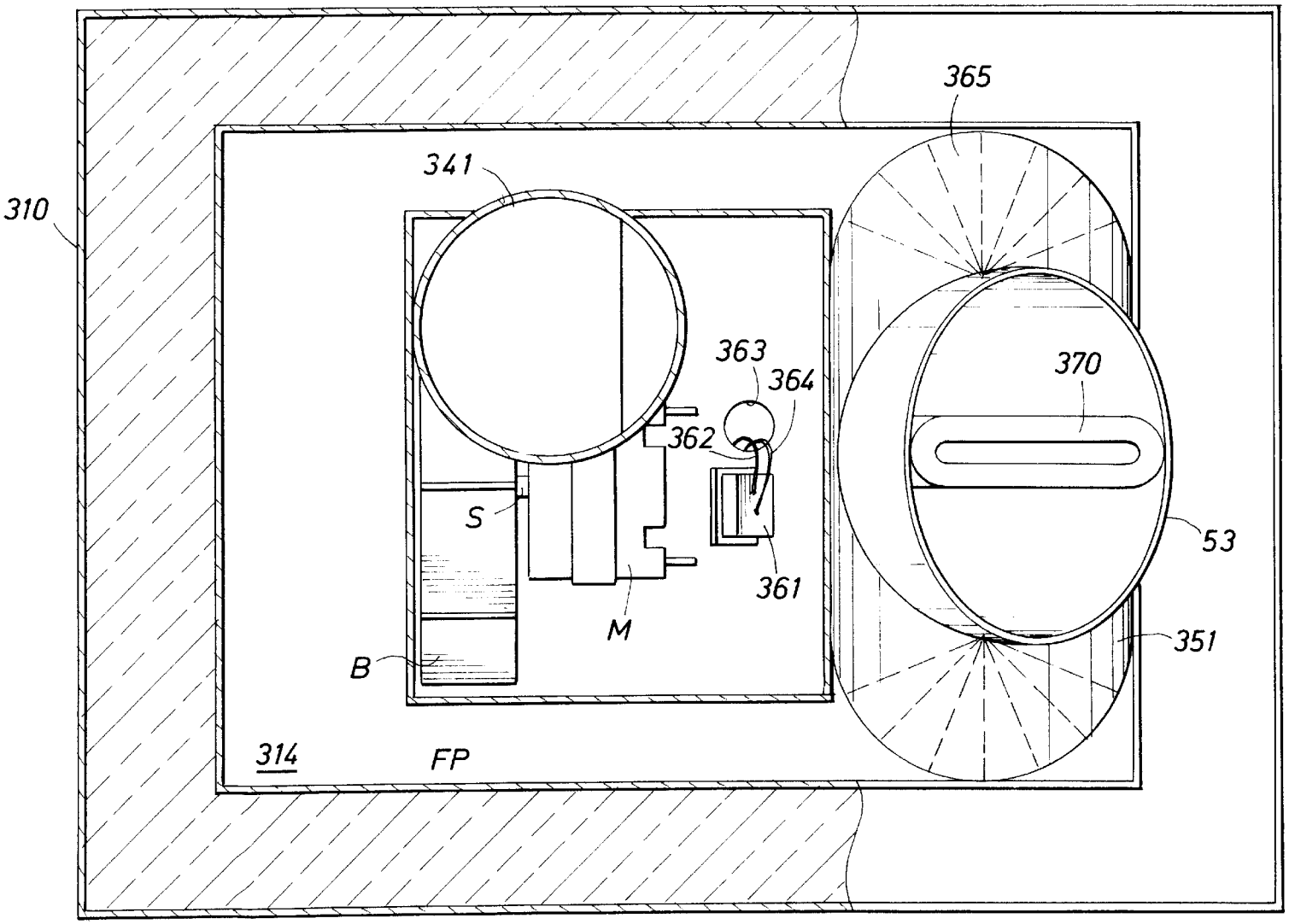
FIG. 3B is a top cross-sectional view of the air exchange system of FIG. 3A according to the present invention.

Referring now to FIG. 3B, a cross-sectional top view of the air exchange apparatus of the present invention is shown. The preceding explanation of FIG. 3A ill generally apply in describing the cross-sectional view of FIG. 3B. Hence, similarly numbered elements bear the same description and need not be discussed further.

In FIG. 3B, the electrical access opening 363 allows wire leads 362 and 364 to penetrate through the rough-in housing 310. Further, the wire leads 362 and 364 are electrically connected to a detachable fan electrical receptacle 361 for connecting into the outside power outlets for powering the motor M of the fan assembly. Further, it will be observed that the generally round, tubular flexible duct 53 for carrying conditioned air into the air exchange unit 300 of the present invention is adapted via the transition plenum 351 such that it gradually becomes a square or a rectangular enclosure of the rough-in housing 310. Such gradual transition from round to square or rectangular aperture allows an air-tight fit with the rough-in housing 310. The present invention contemplates that other modification may be made of the transition plenum 351 without alternation of the operating principle of this device and of the air exchange unit 300, including the termination of the air inlet in an oval shape or any other shape, and of different sizes may be required to fit the ducts as hereinbefore disclosed, depending upon the particular design of the conjoined air conditioning unit.

When air is supplied to the flexible duct 53, the incoming air encounters the ridge 370 which packetizes the air into discrete chambers via the air channeling guide 371. After being packetized and evenly distributed throughout the body of the rough-in housing 310, air is ejected through the filter element F where airborne particulate matter is filtered and removed from the air. The air is further ejected through the passages in the perforated panel of the face plate FP before it is guided through the louvers connected to the face plate and delivered into the bathroom chamber.

Figure 4:
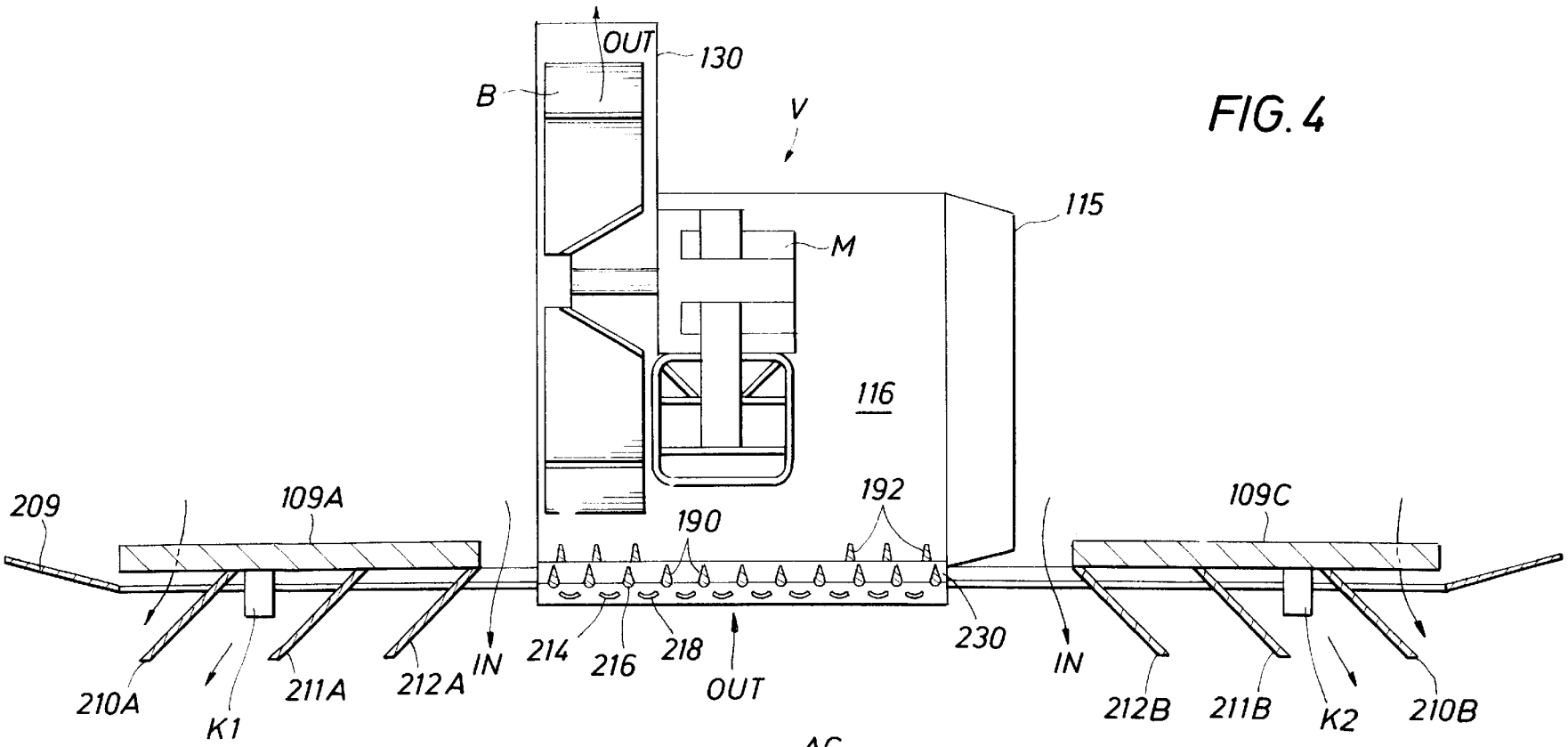
FIG. 4 is a cross-sectional view of a bath fan kit or assembly portion of the air exchange system of FIG. 1 in accordance with the present invention.

Referring now to FIG. 4, the cross-section of the preferred bath fan kit or assembly of FIG. 2A is shown in more detail. The face plate FP has a face plate frame 209. The face plate 209 supports one or more louvers on four sides of the face plate FP, including louvers 210A, 210B, 211A, 211B, 212A and 212B. The louvers 210A, 210B, 211A, 211B, 212A and 212B are angled such that air is maximally distributed into the bathroom. Preferably, the louvers 210A, 210B, 211A, 211B, 212A and 212B are angled at a 45 degree angle away from the fan housing 116. Furthermore, the slidable damper assemblies 109A and 109C are positioned above the face plate frame 209. The sliding damper piece is snapped into the body of the face plate FP. The sliding damper piece of the damper assemblies 109A and 109C of FIG. 4 has knobs K1 and K2 connected to respective sliding surface which, when adjusted, can restrict or enhance air flow through the vanes to provide air flow adjustability.

Furthermore, a vent fan grill assembly 230 is centrally mounted on the face plate frame 209. The vent fan grill assembly 230 has a plurality of upwardly curved baffles 214. Furthermore, a plurality of tear-shaped inner baffles 190 and 216 are spatially positioned behind the outer baffles 214 and 218. Finally, a plurality of air inlet channeling members 192 is further recessed with the outer baffles 214 and the tear-shaped inner baffles 216 and 218.

It is found in practice that the use of the upwardly curved baffle 214 in combination with the tear-shaped inner baffle 216 optimizes the air flow while improving the aesthetics of the bath fan kit or assembly, as the mechanical details within the fan housing 116 is blocked by the series of baffles and channeling members. Accordingly, the air inlet channeling member 192, the tear-shaped inner baffle 216 and the outer baffle 214 are combined in the present invention to efficiently channel the air flow into the chamber within the fan housing 116 for an optimized ejection by the fan blade B at the neck 130. Together, the fan housing 116 and the baffles on the face plate FP define the space where stale air and odoriferous fumes to be removed are temporarily buffered before they are actively pumped into the outside atmosphere.

Although the preferred embodiment deploys a series of outer upwardly curved baffles, inner tear-shaped baffles and air guides, all mounted in a reticulated manner near the center portion of the face plate FP, the present invention also contemplates that conventional air grills having a rectangular framework and a plurality of transverse blades can be utilized. Further, the present invention contemplates that the blades can be rotatable or fixed. Additionally, multiple sets of blades may be utilized, one behind the other, arranged at right angles or at any other angles to each other.

Figure 5:
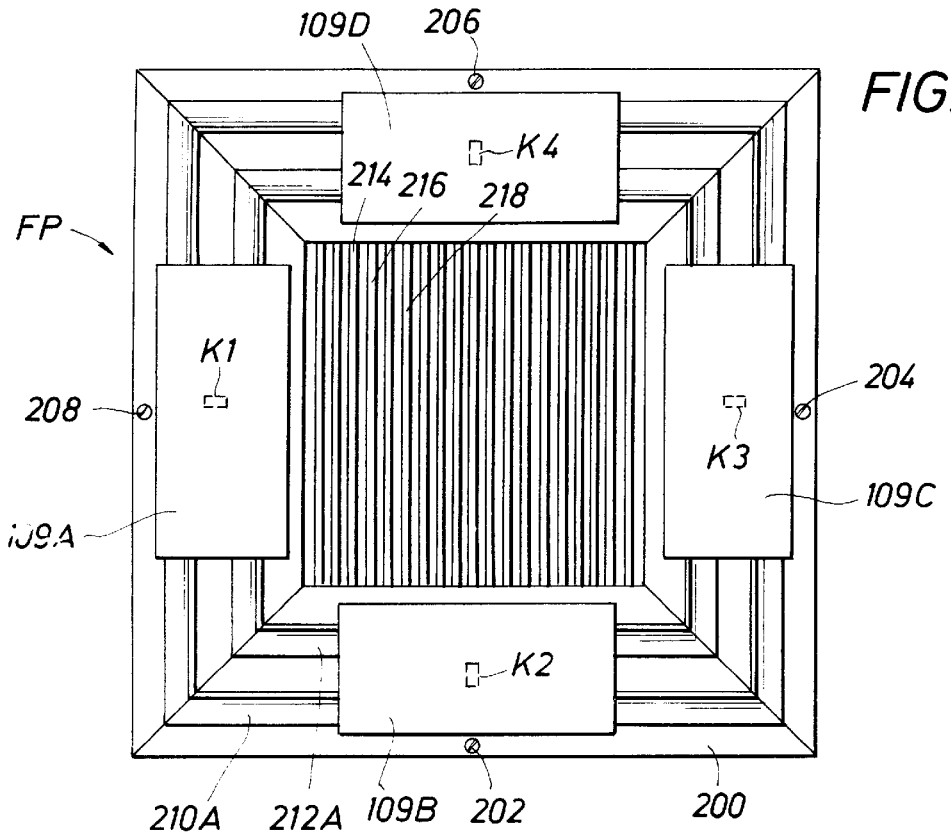
FIG. 5 is a top view of a face plate of the bath fan kit or assembly portion of FIG. 4.

FIG. 5 is a bottom view of the face plate FP of FIGS. 2A and 4. Upon inspection of FIG. 5, it will be seen that the plurality of outside louvers 210A exist on the perimeter of the face plate FP to guide air being delivered into the bathroom BR. Further, a plurality of inside baffles 212A is centrally positioned in conjunction with the outside louvers 210A to provide further air channeling with respect to the air being delivered into the bathroom BR. Additionally, a plurality of outer baffles 214 and tear shaped inner baffles 216 are shown mounted in spaced apart relationship to each other. Thus, as shown in FIG. 4, the air is delivered through the louvers 210A, 210B and 212A and 212B, while outgoing air is efficiently removed via baffles 214, 216 and air inlet channeling members 192. Additionally, the slidable damper assemblies 109A, 109B, 109C and 109D with their respective knobs K1, K2, K3 and K4 are positioned on each of the four sides of the face plate FP. Each of the knobs K1–K4 is connected to its respective sliding surface which, when moved, can restrict or enhance air flow through the vanes to provide air flow adjustability.

Figure 6:
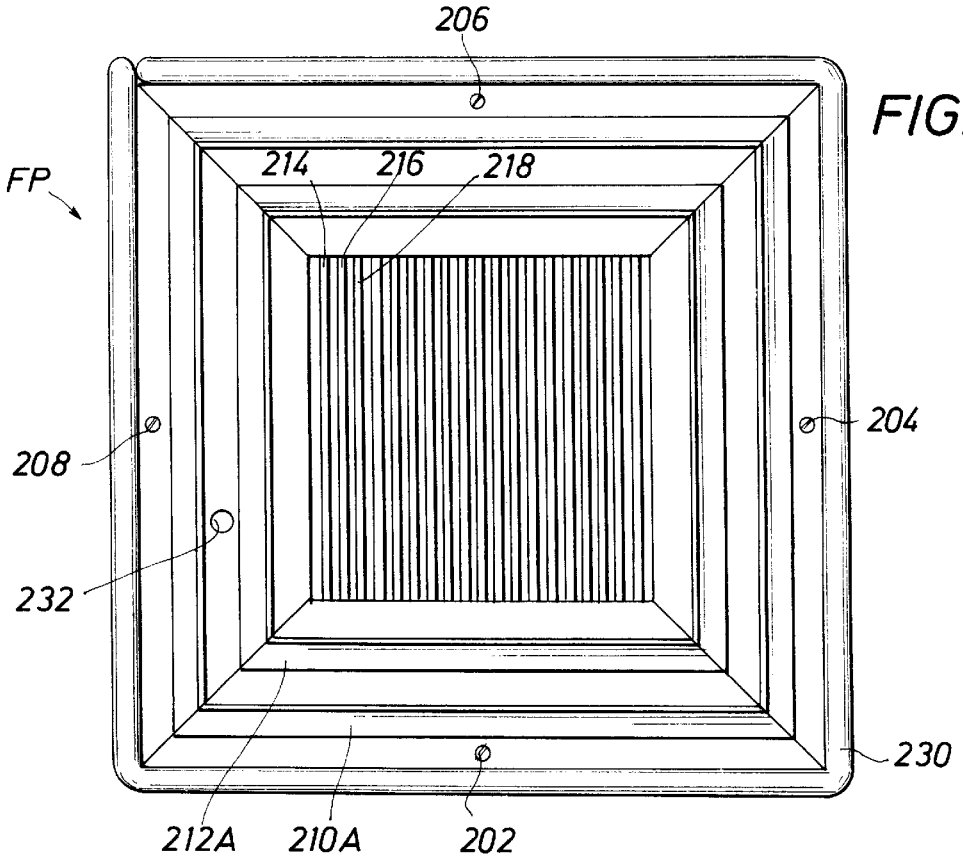
FIG. 6 is a second embodiment of the face plate of FIG. 5 which is adapted to provide additional lighting for the bathroom of FIG. 1.

Turning now to FIG. 6, a second embodiment of the face plate of FIG. is shown. As far as described, the implement of FIG. 6 is essentially like that of FIG. 5. However, the two differ primarily in that FIG. 6 has an additional fluorescent light bulb 230 attached to the perimeter of the face plate FP. The fluorescent light bulb 230 provides additional light in the bathroom BR for additional productivity enhancement purposes such as that discussed above. The fluorescent light bulb 230 has an electrical receptacle (not shown) which is electrically linked to that of the wire leads 162 and 164 to power the fluorescent light bulb 230. Thus, the fluorescent light bulb 230 and the motor M of the air exchange unit 100 of the present invention can be turned on or turned off using the same switch as is controllable by the occupant of the bathroom BR.

Figure 7:
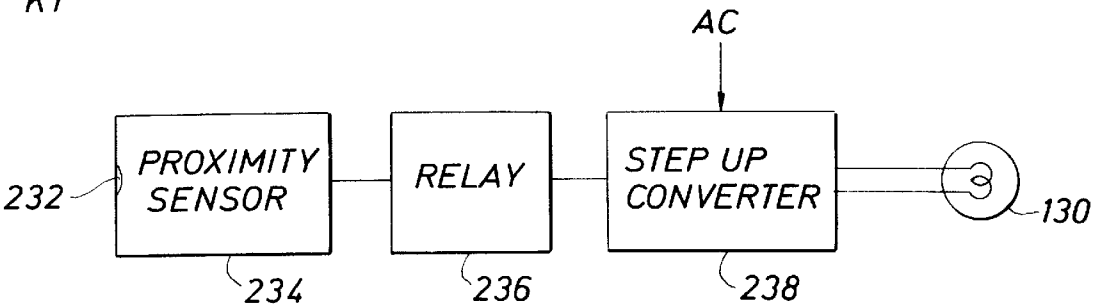
FIG. 7 is a schematic diagram of the electrical components associated with the light of FIG. 6 in accordance with the present invention.
Figure 8:
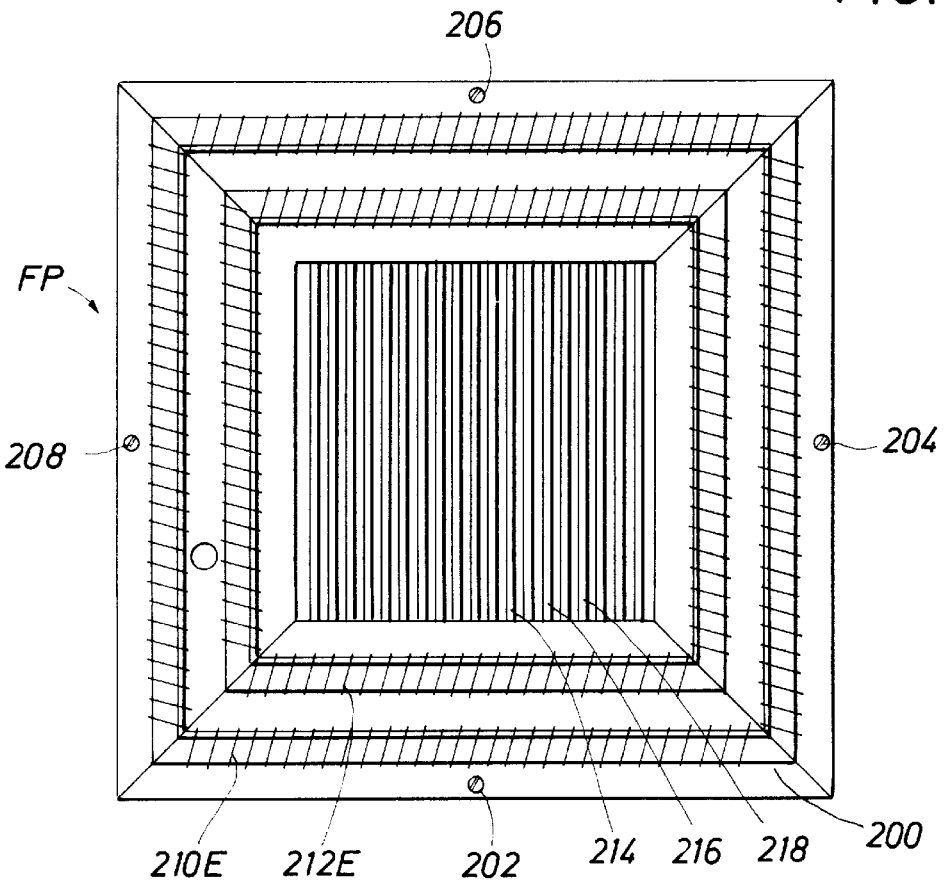
FIG. 8 is a second embodiment of the face plate of FIG. 5 which is adapted to providing additional heat into the bathroom of FIG. 1.

Although the fluorescent light bulb and the motor M of FIGS. 2 and 6 can be manually turned on or off, the present invention also contemplates that they be automatically turned on or off by sensing the presence or the absence of the occupant. The circuitry to perform this automatic turn-on and turn-off of the light bulb 230 and the motor M in the air exchange unit 100 of the present invention is shown in FIG. 7. Referring now to FIG. 7, a proximity sensor 234 is connected to the access hole 232 for detecting the absence or the presence of the occupant. The proximity sensor 234 is further connected to a relay 236 for turning on or off a step-up converter 238. The step-up converter 238 is further connected to the alternating inlets near the wire leads 162 and 164. The step-up converter 238 generates a high voltage of a sufficient level to turn on the fluorescent light bulb 230 of FIG. 6. Thus, upon detecting the presence of the occupant, the relay 236 is turned on to enable the step-up converter to generate a voltage to light the fluorescent bulb 230. FIG. 8 illustrates a third embodiment of the face plate FP of the present invention. In FIG. 8, a plurality of heater wires 210E and 212E are spirally coiled and resiliently mounted onto the louvers surrounding the perimeter of the face plate FP. The embodiment of FIG. 8 is particularly appropriate for cold weather environments. Thus as air exits the face plate FP of FIG. 8, the air is heated by the heating wires 210E and 212E such that heated air is delivered into the confines of the bathroom BR. The heating wires 210E and 212E are electrically connected to the wire leads 162 and 164, similar to the manner in which the light bulb 230 is connected to a power source in FIG. 6.

Although the heating coils 210E and 212E and the motor can be manually turned on or off, the invention further contemplates that the heating wires and the motor can be automatically activated when the bathroom BR is in use. Thus, in FIG. 9, a proximity sensor 234 detects when an occupant has entered the bathroom BR. When the bathroom BR is in use, the proximity sensor 234 actuates the relay 236 to apply power to the heating wires 210E and 212E. Thus, warm air can be delivered to the occupant to provide a more comfortable operating environment.

Figure 9:
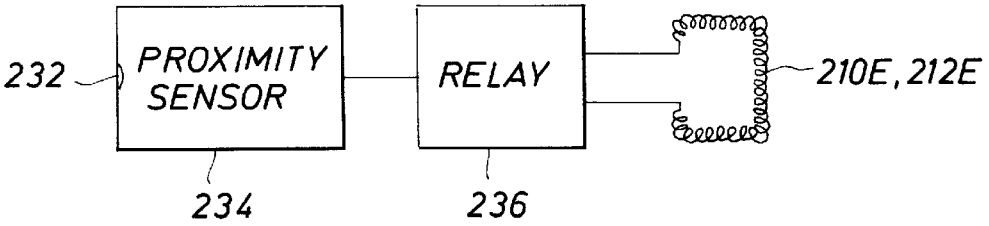
FIG. 9 is a schematic diagram of the electrical circuitry associated with FIG. 8 for heating the bathroom of the present invention.
Figure 10:
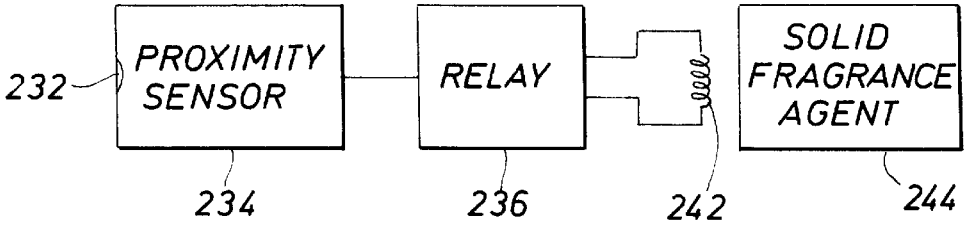
FIG. 10 is a schematic diagram of the electrical circuitry associated with FIG. 8 in accordance with a third aspect of the present invention for providing fragrance to the bathroom.

Turning now to FIG. 10, another embodiment of FIG. 9 is shown. In the embodiment of FIG. 10, a low-powered heating coil 242 is attached to the relay 236. Further, a solid fragrance agent 244 is proximately mounted to the low-powered heating coil 242. Upon actuation by the proximity sensor 234 in response to the occupation of the bathroom BR, the low-powered heating coil 242 heats up which melts a thin layer on the solid fragrance agent facing the heating coil 242. The melting of a thin layer of the solid fragrance agent 244 converts the fragrance from a solid state into a gaseous state, whereupon the fragrance is delivered into the environment of the bathroom BR to provide a more pleasant experience in using the bathroom BR.

Thus, in the present invention, high air exchange efficiency is achieved via louvers which are provided around the perimeter of the face plate of the trim kit or assembly to dispense conditioned air from the air inlet to the confined space with the appropriate air gradient. Further, baffles are positioned centrally on the face plate to guide the removal of stale air and noxious fumes to the outside atmosphere from the confined space of the bathroom, as vacuumed by the motorized fan assembly centrally positioned above the face plate. Thus, the present invention supports more quality time in the confines of the bathroom such that the occupants can be refreshed and ready to respond to the challenges of the modern civilization.

The present invention also provides a simple, efficient and cost effective method for installing bathroom air exchange systems by eliminating one half of the installation labor. Furthermore, the single assembly of the rough-in kit or assembly and the trim kit or assembly provides an economical, aesthetically pleasing, yet high performance air exchange system which can be installed in fewer steps and which provides a less intrusive appearance on the ceiling or wall of the confined space.

It is to be understood that the above-described arrangements are only illustrative of an application of the present invention. Numerous modifications and alternative arrangements may be devised by those skilled in the art without departing from the spirit and scope of the present invention and the appended claims are intended to cover such modifications and arrangements.

What is claimed:

1. An air exchange apparatus for ventilating a room comprising:

a rough-in assembly having an air inlet and an air outlet;

a face plate adapted to be attached to said rough-in assembly, said face plate having one or more louvers for distributing air into said room and one or more baffles through which stale air can be drawn from the room;

fan assembly positioned above said baffles, said fan assembly having a fan assembly inlet for receiving said stale air and a fan assembly outlet coupled to said rough-in assembly air outlet;

said fan assembly comprising:

a fan assembly housing mounted on top of said face plate;

a motor mounted inside said fan assembly housing; and an impeller rotatably attached to said motor; and a vent fan grill assembly centrally positioned on said face plate, said vent fan grill assembly having one or more upwardly curved baffles and one or more tear-shaped inner baffles proximately mounted above said upwardly curved baffles.

2. The air exchange apparatus of claim 1, further comprising one or more air inlet channeling members, said air inlet channeling members proximately positioned above said upwardly curved baffles and said tear-shaped inner baffles.

3. The air exchange apparatus of claim 1, wherein said face plate has a sliding damper assembly positioned above said louver to provide air flow adjustability.

4. The air exchange apparatus of claim 1, wherein said rough-in assembly further comprises an insulating barrier lining the perimeter of said rough-in assembly.

5. The air exchange apparatus of claim 1, further comprising a transition plenum coupled to said rough-in assembly for distributing air from said air inlet over said rough-in assembly.

6. The air exchange apparatus of claim 1, wherein said air outlet further comprises a one-way air vent coupled to said air outlet to prevent particles from entering the room via said air outlet.

7. The air exchange apparatus of claim 6, wherein said one-way air vent is a damper movably coupled to said air outlet.

8. The air exchange apparatus of claim 1, further comprising a light generator coupled to said fan assembly.

9. The air exchange apparatus of claim 1, further comprising a heater coupled to said fan assembly.

10. The air exchange apparatus of claim 1, further comprising a fragrance generator coupled to said fan assembly.

11. The air exchange apparatus of claim 1, further comprising an air conditioner coupled to said air inlet.

12. The air exchange apparatus of claim 1, further comprising a heater coupled to said air inlet.

13. The air exchange apparatus of claim 1, further comprising a proximity detector coupled to said fan assembly, said proximity detector turning on said fan assembly upon detecting the presence of an occupant and otherwise turning off said fan assembly.

* * * * *